US008782936B2

(12) United States Patent
Logan et al.

(10) Patent No.: US 8,782,936 B2
(45) Date of Patent: Jul. 22, 2014

(54) END FRAME FOR DISPLAY STRUCTURE

(71) Applicant: Target Brands, Inc., Minneapolis, MN (US)

(72) Inventors: Robert G. Logan, Blaine, MN (US); Jeremy A. Clark, Minneapolis, MN (US); David H. Cheney, Shoreview, MN (US); Paul A. Schlough, Andover, MN (US); Jason L. Dusbabek, Elk River, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/712,530

(22) Filed: Dec. 12, 2012

(65) Prior Publication Data

US 2014/0157637 A1 Jun. 12, 2014

(51) Int. Cl.
*G09F 15/00* (2006.01)

(52) U.S. Cl.
CPC ..... *G09F 15/00* (2013.01)
USPC ..... 40/606.01; 40/606.03; 40/607.01; 40/607.02; 40/607.1

(58) Field of Classification Search
USPC ..... 40/606.19, 607.01, 607.02, 607.09, 40/611.06, 617; 211/134–153
See application file for complete search history.

(56) References Cited

U.S. PATENT DOCUMENTS 1,824,578 A 9/1931 Thake
D194,019 S 11/1962 Smith
3,154,870 A * 11/1964 Hopp et al. ..... 40/605
3,778,915 A * 12/1973 Freeman et al. ..... 40/605
4,191,298 A 3/1980 Broudy
4,237,636 A * 12/1980 Matthews ..... 40/607.13
4,258,494 A 3/1981 Borque
4,408,407 A * 10/1983 Bloom et al. ..... 40/611.05
4,742,633 A 5/1988 Snediker
4,785,946 A * 11/1988 Sorensen ..... 211/187
4,790,091 A 12/1988 Hull
4,854,533 A 8/1989 Sainato
4,887,783 A 12/1989 Franklin
5,012,603 A * 5/1991 Elcock ..... 40/605
5,236,095 A 8/1993 Krizka
5,419,134 A * 5/1995 Gibson ..... 40/611.05
5,433,046 A 7/1995 MacQuarrie et al.
(Continued)

OTHER PUBLICATIONS

U.S. Appl. No. 29/412,399, filed Feb. 2, 2012 (9 pages).

*Primary Examiner* — Joanne Silbermann
*Assistant Examiner* — Christopher E Veraa
(74) *Attorney, Agent, or Firm* — Griffiths & Seaton PLLC; JoAnn M. Seaton

(57) ABSTRACT

An end frame assembly configured to be coupled to a product display structure includes an elongated post, an arm, and a sign holder. The arm is coupled to and extends away from a top end of the elongated post to define a free end opposite the elongated post, defines an internal cavity, and includes a bottom panel defining two or more slots extending longitudinally through the bottom panel of the arm between the free end and the elongated post. Each of the two or more slots provides access to the internal cavity. The sign holder defines a top edge including a rail section. The rail section slidably couples with the arm via one of the two or more slots and is at least partially maintained within the internal cavity of the arm. The sign holder extends through the slot and hangs downwardly from the bottom panel of the arm.

22 Claims, 11 Drawing Sheets

(56) References Cited

U.S. PATENT DOCUMENTS

| | | | | |
|---|---|---|---|---|
| 5,443,167 | A * | 8/1995 | Menaged et al. | 211/106.01 |
| 5,462,178 | A | 10/1995 | Wallach et al. | |
| D371,026 | S | 6/1996 | Hendler et al. | |
| 5,624,044 | A * | 4/1997 | Black, Jr. | 211/186 |
| 5,660,286 | A | 8/1997 | Shea | |
| 5,722,623 | A | 3/1998 | Gibson | |
| 5,933,992 | A | 8/1999 | Padiak et al. | |
| RE36,669 | E | 4/2000 | Zilincar, III | |
| D434,082 | S | 11/2000 | Tsiogas | |
| D454,373 | S | 3/2002 | Kosir | |
| 6,523,291 | B2 | 2/2003 | Nagel | |
| 6,533,134 | B1 | 3/2003 | Menaged et al. | |
| 6,601,328 | B1 | 8/2003 | Benaquista et al. | |
| 6,607,083 | B1 * | 8/2003 | Webb | 211/59.2 |
| D479,277 | S * | 9/2003 | Strunk et al. | D20/41 |
| 6,698,124 | B2 | 3/2004 | Kump et al. | |
| 6,932,226 | B2 | 8/2005 | Hardy | |
| 6,996,929 | B1 * | 2/2006 | Greene et al. | 40/617 |
| 7,600,895 | B2 | 10/2009 | Hawkins et al. | |
| 7,797,869 | B2 | 9/2010 | Tollis et al. | |
| D625,760 | S | 10/2010 | Wormser | |
| D628,653 | S | 12/2010 | Shedarowich | |
| D631,097 | S | 1/2011 | Giugiaro | |
| 7,946,066 | B2 * | 5/2011 | Wamsley | 40/657 |
| D647,978 | S | 11/2011 | Bacskai et al. | |
| D664,599 | S | 7/2012 | Clark et al. | |
| 2002/0026737 | A1 * | 3/2002 | Tramont | 40/611 |
| 2006/0185203 | A1 * | 8/2006 | Bittle et al. | 40/541 |
| 2007/0209259 | A1 | 9/2007 | Pavlik et al. | |
| 2008/0149576 | A1 | 6/2008 | Onachilla et al. | |
| 2011/0192812 | A1 | 8/2011 | Weigand et al. | |
| 2011/0219653 | A1 | 9/2011 | Shea et al. | |

* cited by examiner

END FRAME FOR DISPLAY STRUCTURE

BACKGROUND OF THE INVENTION

Signs are commonly used in retail settings to present information to a customer about products for purchase. For example, overhead signs are hung from a surface over one or more display structures to indicate the general location of certain products. Similarly, upright signs can be positioned adjacent display structures or in aisles between display structures to direct the customer to a product location. The upright signs can include arrows or other indicia guiding the customer in a certain direction. Alternatively or additionally, the upright signs can include maps or other drawings showing locations of various departments within the store and general areas in which a product may be located. In other instances, signs are attached directly to the display structures, such as on shelving, to provide identifying, promotional, and/or price information to the customer.

SUMMARY OF THE INVENTION

One aspect of the present invention relates to an end frame assembly configured to be coupled to a product display structure. The end frame assembly includes an elongated post, an arm, and a sign holder. The elongated post defines and extends between a bottom end and a top end. The arm is coupled to and extends away from the top end of the elongated post to define a free end opposite the elongated post, defines an internal cavity, and includes a bottom panel defining two or more slots extending longitudinally through the bottom panel of the arm between the free end and the elongated post. Each of the two or more slots provides access to the internal cavity. The sign holder defines a top edge including a rail section. The rail section of the sign holder slidably couples with the arm via one of the two or more slots and is at least partially maintained within the internal cavity of the arm. The sign holder extends through the one of the two or more slots and hangs downwardly from the bottom panel of the arm. Other assemblies, methods, etc. are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
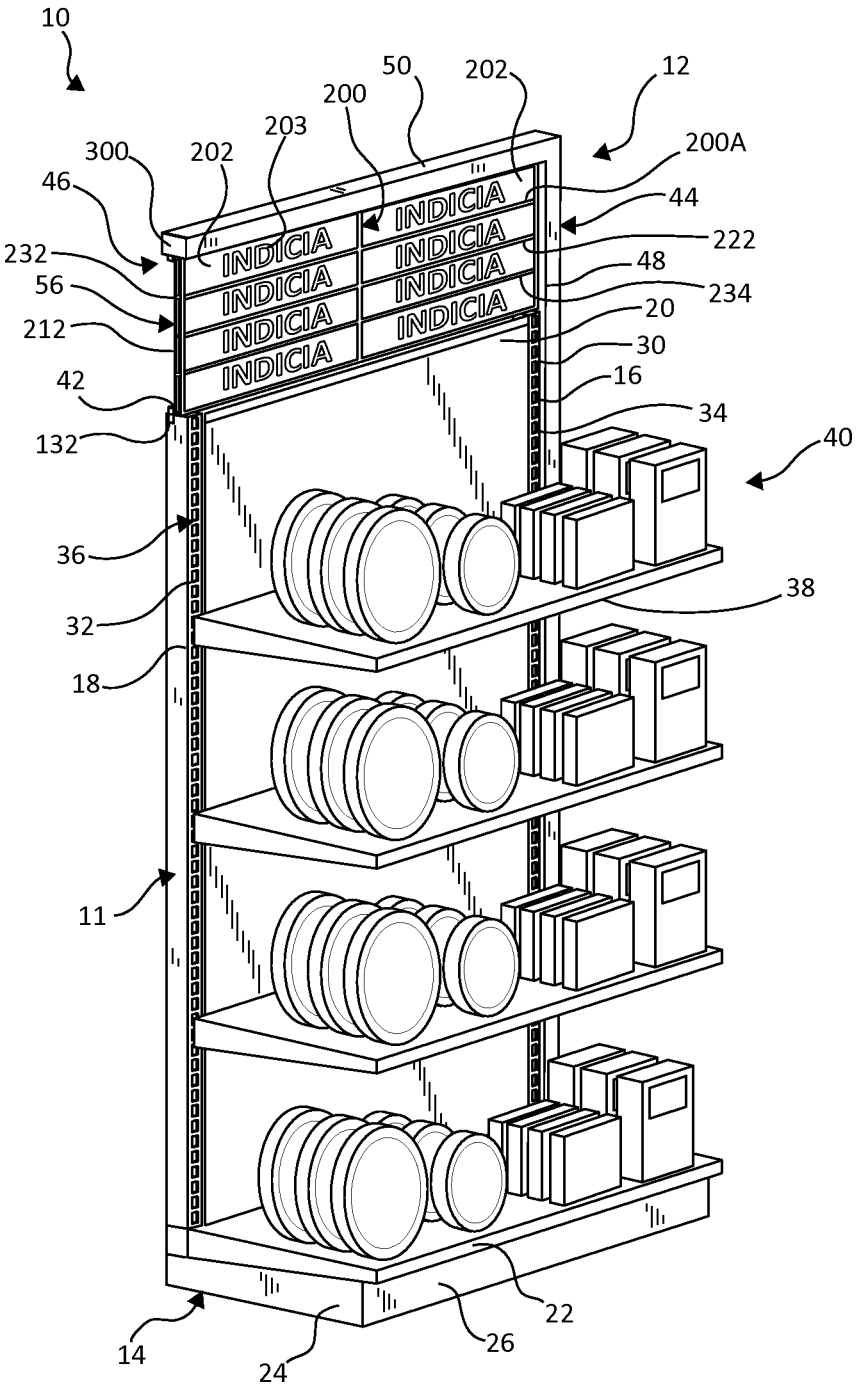
FIG. 1 is a front, perspective view illustration of a display system including an end frame assembly coupled to a display structure having product displayed thereon, according to one embodiment of the present invention.
Figure 2:
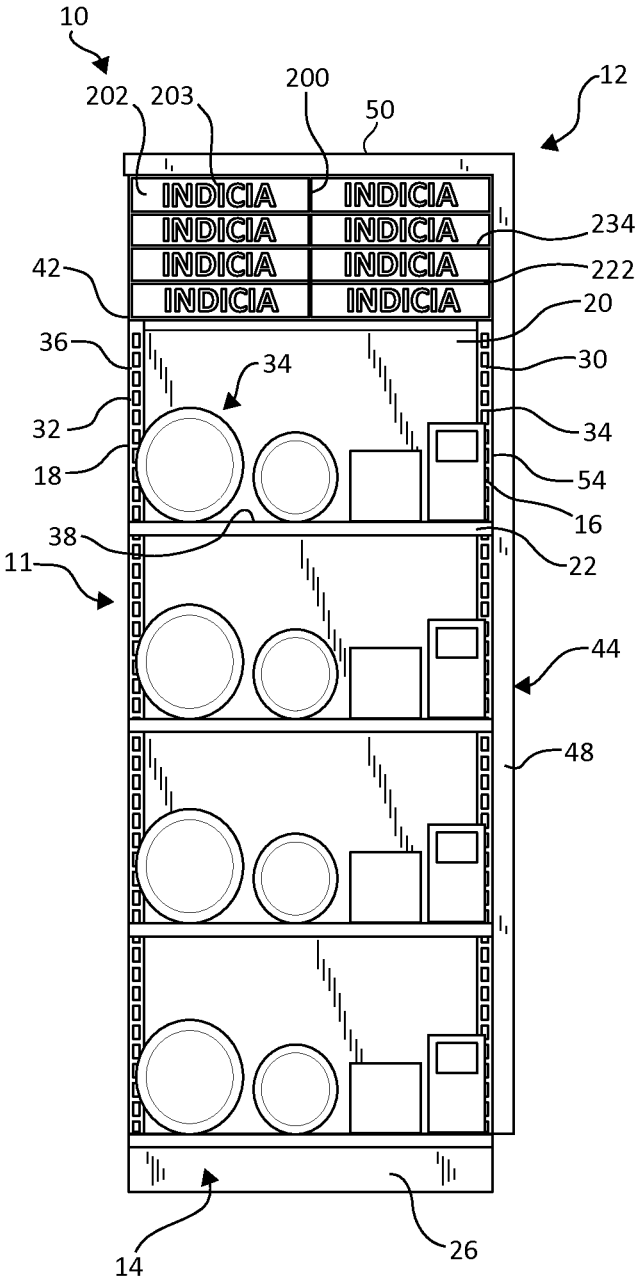
FIG. 2 is front view illustration of the display system of FIG. 1, according to one embodiment of the present invention.
Figure 3:
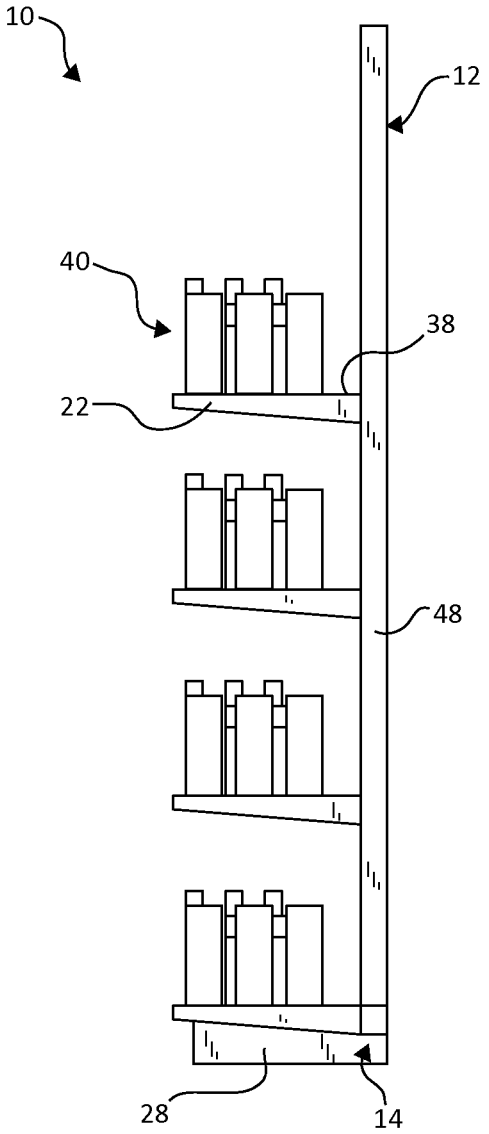
FIG. 3 is a right side view illustration of the display system of FIG. 1, according to one embodiment of the present invention.
Figure 4:
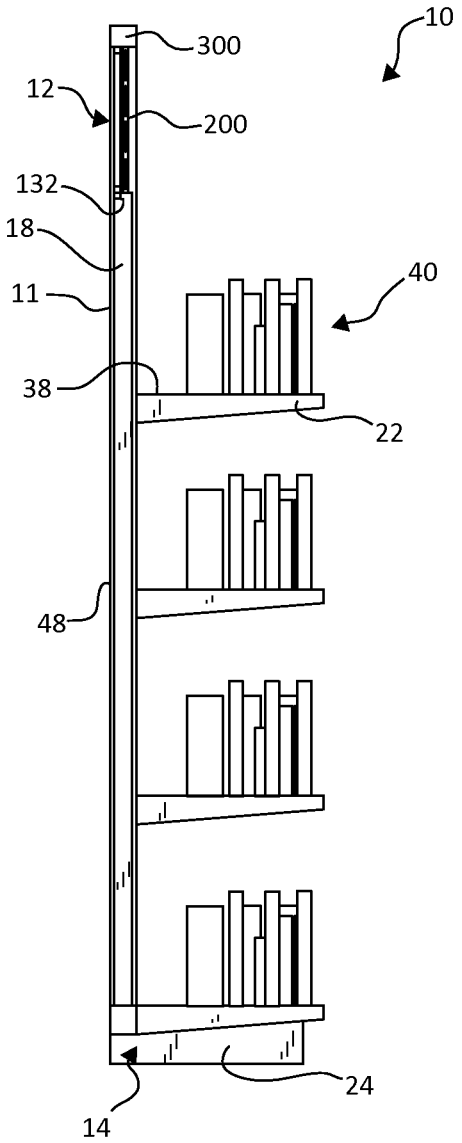
FIG. 4 is a left side view illustration of the display system of FIG. 1, according to one embodiment of the present invention.
Figure 5:
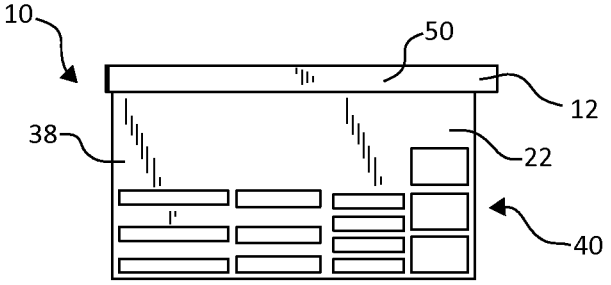
FIG. 5 is a top view illustration of the display system of FIG. 1, according to one embodiment of the present invention.
Figure 6:
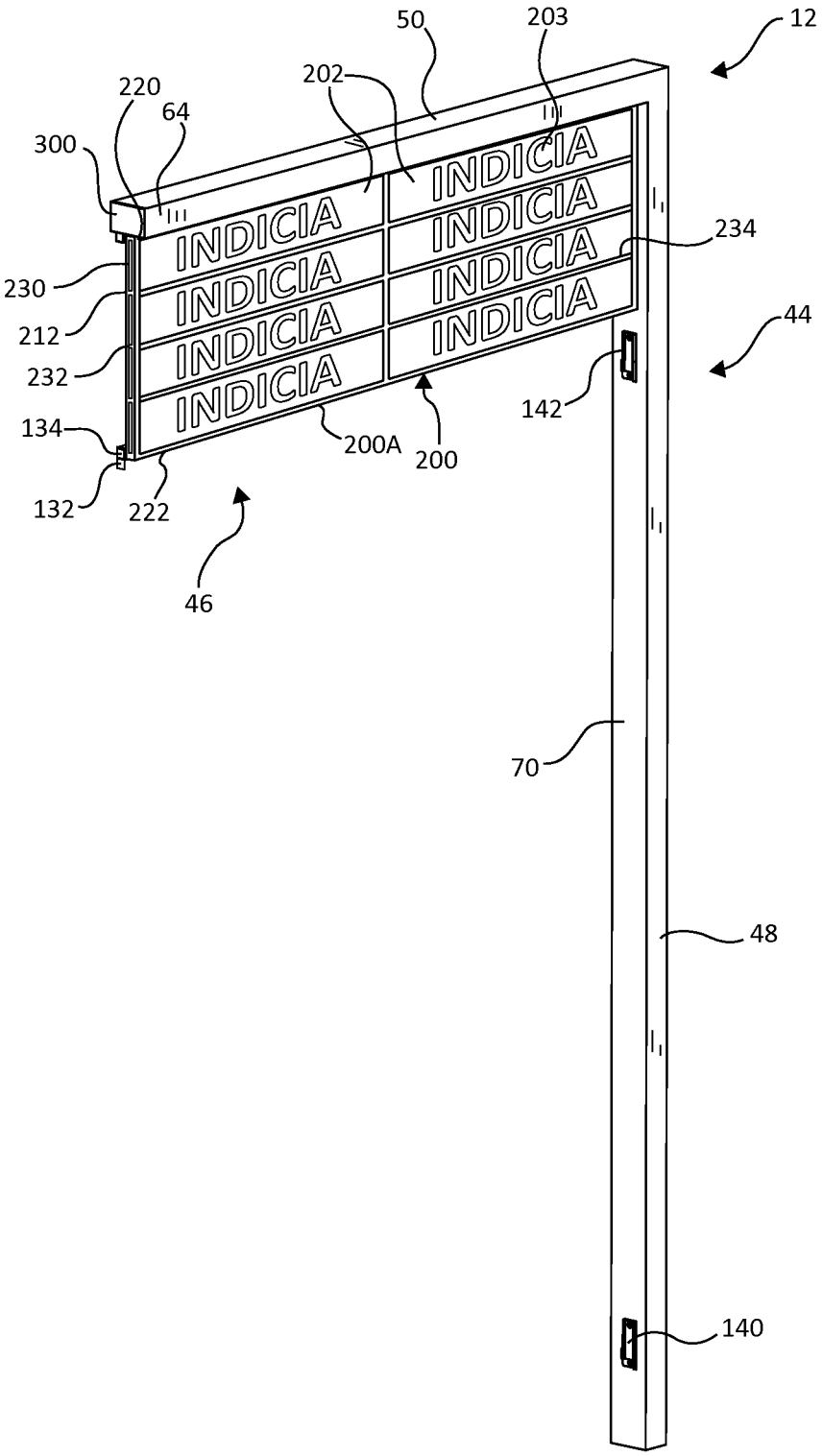
FIG. 6 is a front perspective view illustration of the end frame assembly of FIG. 1, according to one embodiment of the present invention.

A new, versatile end frame assembly extends above a height of a display structure providing additional display or marketing area to the display structure without increasing the overall footprint of the display structure. In one example, the end frame assembly has a substantially L-shape and is made up of an elongated post that extends along a vertically extending support of the display structure and an arm that extends horizontally from a top end of the elongated post over the display structure. In one embodiment, a support frame extends between a top edge of the display structure and the lower surface of the arm to provide additional support to the arm. For added security, the support frame may additionally be attached to the elongated post. The arm defines a plurality of slots or tracks formed along its length for selectively receiving and retaining signs and/or sign holders such that the sign(s) generally hang(s) down from the arm above the display structure. In other configurations, the support frame is omitted and the elongated post extends slightly above the vertically extending support so that the arm rests directly on a top portion of the display structure.

FIGS. 1-5 provide various views of an embodiment of a display system 10 including a display structure 11 and an end frame assembly 12 (such as a navigational assembly) coupled thereto. Display structure 11 generally includes a base 14, vertically extending supports 16 and 18, a planar display board 20, and horizontal-shelving units 22. Base 14 is a generally rectangular and includes at least three sidewalls 24, 26, and 28 that extend between a support surface (such as a floor) and a bottommost one of horizontal shelving units 22.

Vertically extending supports 16 and 18 are positioned opposite one another and extend upwardly from base 14 from, for example, a rear portion of base 14. Vertically extending supports 16 and 18 include a forward surface 30 and a forward surface 32, respectively, each including an array of slots 34 and 36, respectively, for receiving fastening mechanisms to attach various components to display structure 11. For example, horizontal shelving units 22 are coupled to display structure 11 via prongs (not shown) that are selectively inserted into corresponding ones of the array of slots 34 and 36 on vertically extending supports 16 and 18. In this way, horizontal shelving units 22 are selectively coupled to vertically extending supports 16 and 18 and extend outwardly from display structure 11 to provide display surfaces 38 for presenting various products 40. Use of other display accessories such as hanging rods, support pockets, etc. supported by and extending between vertically extending supports 16 and 18 or otherwise incorporated into display structure 11 are also contemplated.

To provide an aesthetically pleasing, uniform appearance and/or additional structural integrity to display system 10, planar display board 20 is retained between vertically extending supports 16 and 18 of display structure 11. Display board 20 is made from particleboard, plastic, glass, wood, or another sturdy material and can be opaque, semi-opaque, or transparent. To further improve aesthetics, display board 20 can have a smooth, textured, solid- or multi-colored surface or can be covered with a cloth, plastic, or other material.

End frame assembly 12 is secured to display structure and, in one embodiment, surrounds at least a portion (e.g., two sides) of display structure 11. In one embodiment, end frame assembly 12 extends both over a top surface 42 of display structure 11 and in parallel with and attached to vertically extending support 16 of display structure 11, as illustrated in FIGS. 1-5, or, alternatively, to vertically extending support 18. With additional reference to FIGS. 6-9, end frame assembly 12 includes a primary frame or primary structure 44 and an extender section or support frame 46, according to one embodiment of the invention. In one embodiment, top surface 42 is a topmost surface or edge of display structure 11.

Primary structure 44 is a substantially L-shaped, unitary component defined generally by an elongated post 48 and an arm 50. Primary structure 44 is made from plastic, metal, or another suitable material having structural integrity and may be painted, coated, or covered with another material. Surfaces of primary structure 44 visible to a customer can include coloring, indicia, and/or writing to indicate to the customer aisle numbers, product information, and the like. In one embodiment, primary structure 44 is conspicuously colored or otherwise marked, such that when a plurality of primary structures 44 are used along a retail aisle, the series of primary structures 44 provide a uniform aesthetic appearance to the retail aisle as well as navigational information assisting a consumer in proceeding through the store and finding desired items. In one example, elongated post 48 and arm 50 are each formed from lengths of tubular material having a square or otherwise suitably shaped and hollow cross-section.

Figure 10:
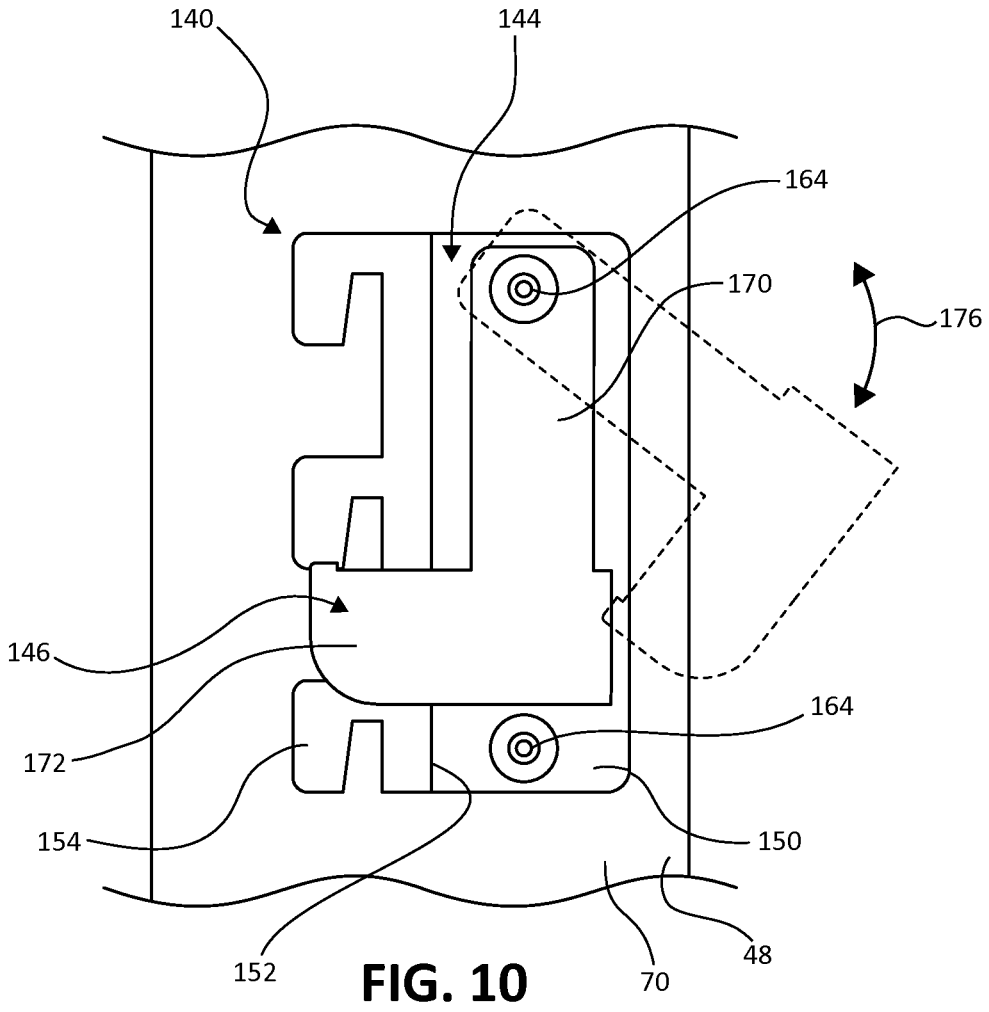
FIG. 10 is left side view of a coupling mechanism on an elongated post of the end frame assembly of FIG. 7, according to one embodiment of the present invention.
Figure 11:
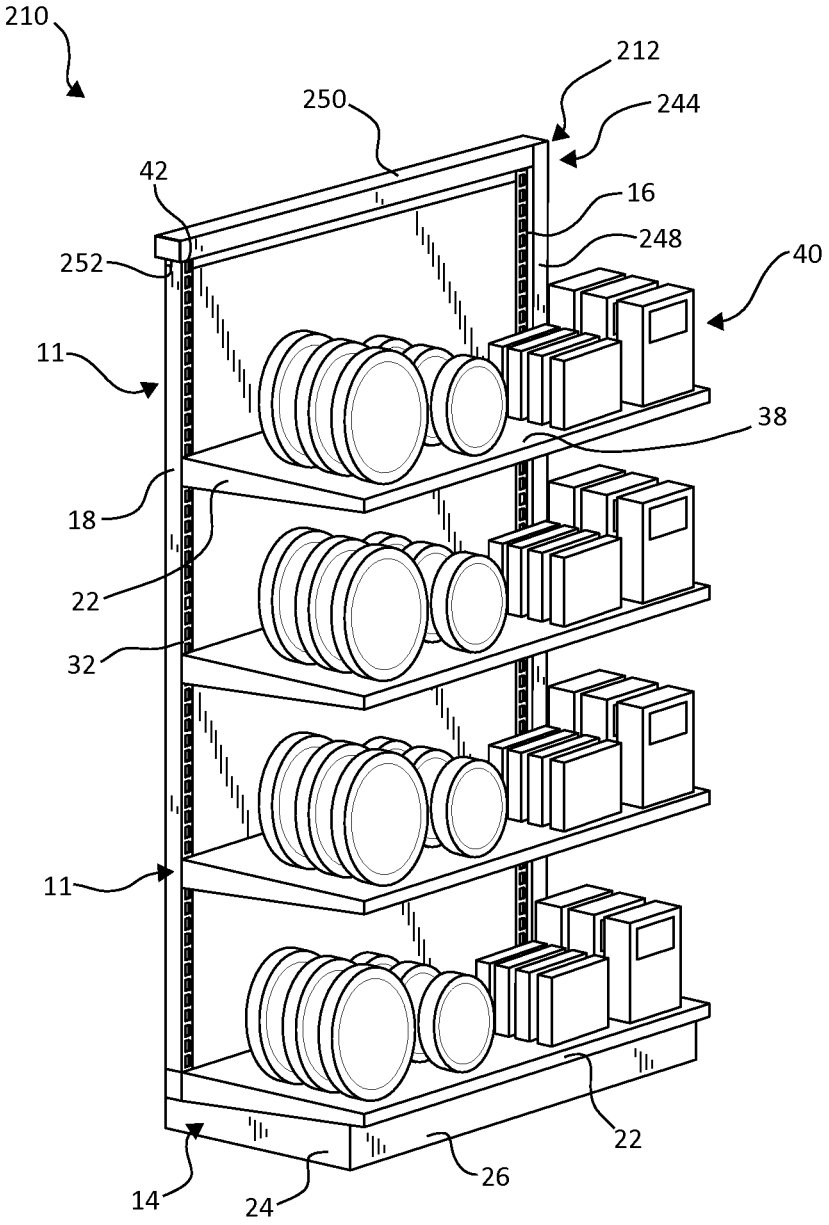
FIG. 11 is a front, perspective view illustration of a display system including an end frame assembly coupled to a display structure having product displayed thereon, according to one embodiment of the present invention.
Figure 12:
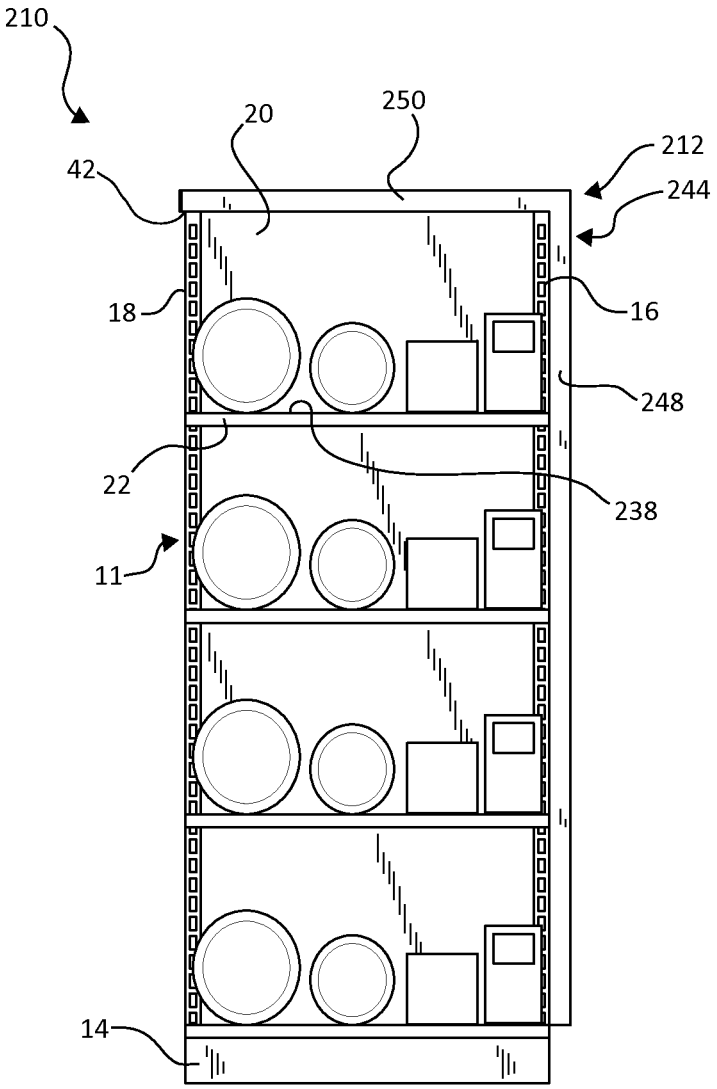
FIG. 12 is a front view illustration of the display system of FIG. 11, according to one embodiment of the present invention.
Figure 13:
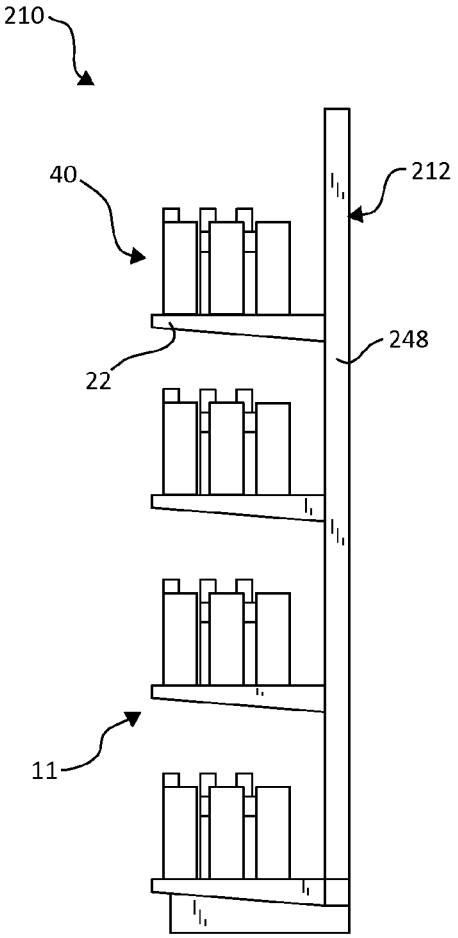
FIG. 13 is a right side view illustration of the display system of FIG. 11, according to one embodiment of the present invention.
Figure 14:
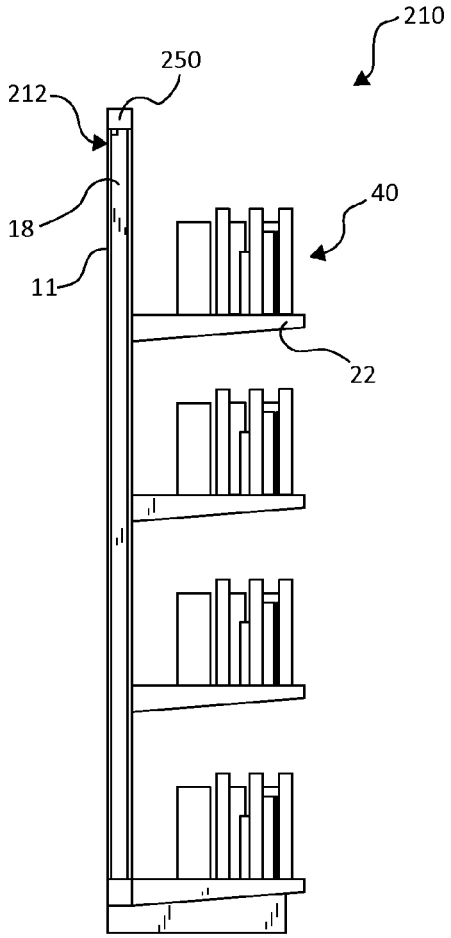
FIG. 14 is a left side view illustration of the display system of FIG. 11, according to one embodiment of the present invention.
Figure 15:
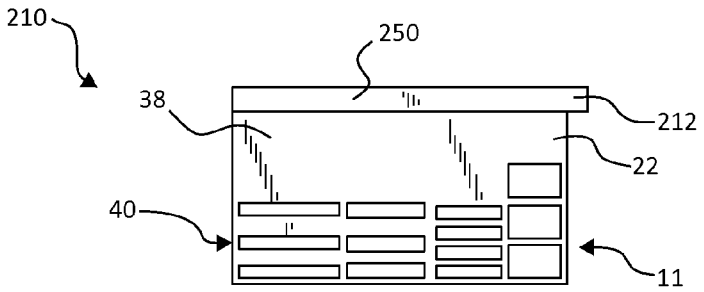
FIG. 15 is a top view illustration of the display system of FIG. 11, according to one embodiment of the present invention.
Figure 17:
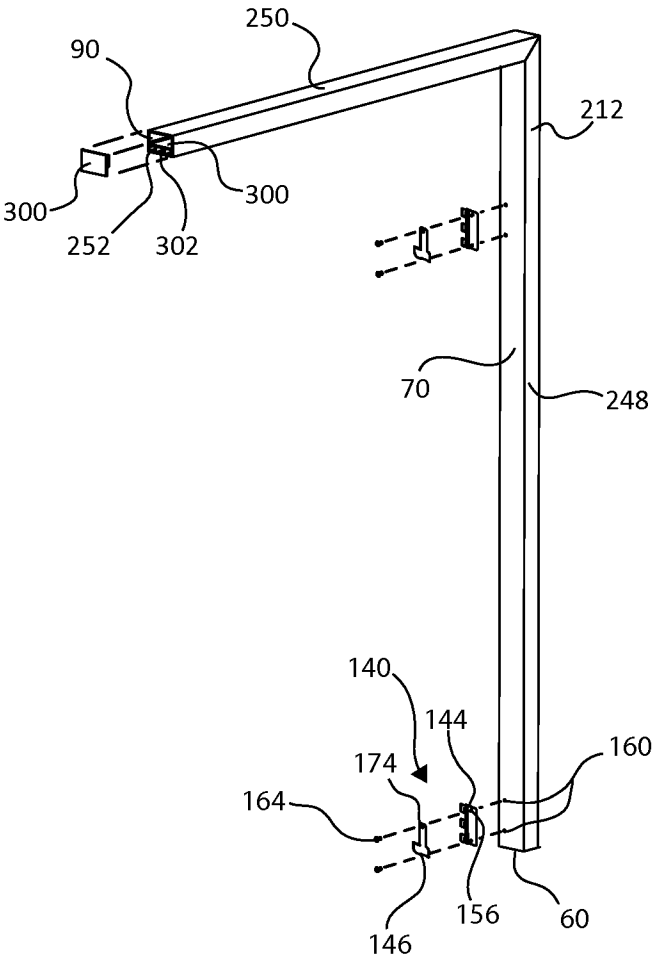
FIG. 17 is an exploded view illustration of the end frame assembly of FIG. 11, according to one embodiment of the present invention.
Figure 16:
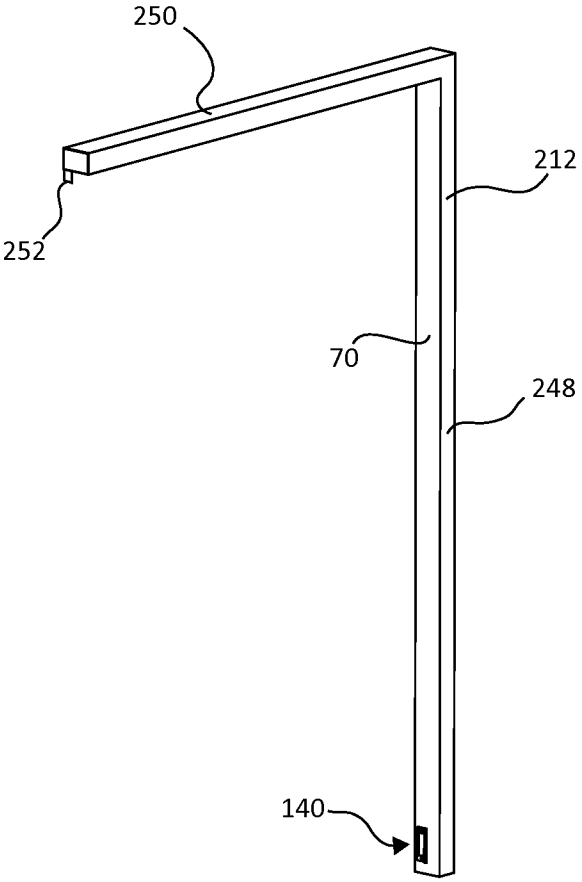
FIG. 16 is a front perspective view illustration of the end frame assembly of FIG. 11, according to one embodiment of the present invention.

Elongated post 48 extends substantially vertically and, in one embodiment, substantially linearly from a bottom-most end 60 to a topmost end 62 and defines an interior-facing surface 70. As illustrated, elongated post 48 has a substantially rectangular, lateral cross section, for instance, a hollow or tubular cross-section. Alternatively, elongated post 48 has an ovular, circular, or other polygonal cross section, which may be selected to match a desired look of display structure 11 as illustrated in FIGS. 1 and 10.

Arm 50 extends in a direction substantially perpendicularly relative to elongated post 48 from a topmost end 62 of elongated post 48 to an opposite and free end 64. According to one embodiment, elongated post 48 extends substantially vertically, and arm 50 extends substantially horizontally. In one example, arm 50 is formed of a tubular material having a rectangular or square cross-sectional shape, for example, substantially identical to the shape of elongated post 48. Arm 50 is shorter in length than elongated post 48, in one example. A length of arm 50, as measured from an interior-facing surface 70 of elongated post 48 to free end 64, is, according to one embodiment, substantially identical to or slightly longer than an overall width of display structure 11, as measured from opposing outside surfaces of vertically extending supports 16 and 18 of display structure 11. Due to the hollow and tubular nature of arm 50, free end 64 of arm 50 defines an opening 90 to the hollow interior thereof.

Figure 8:
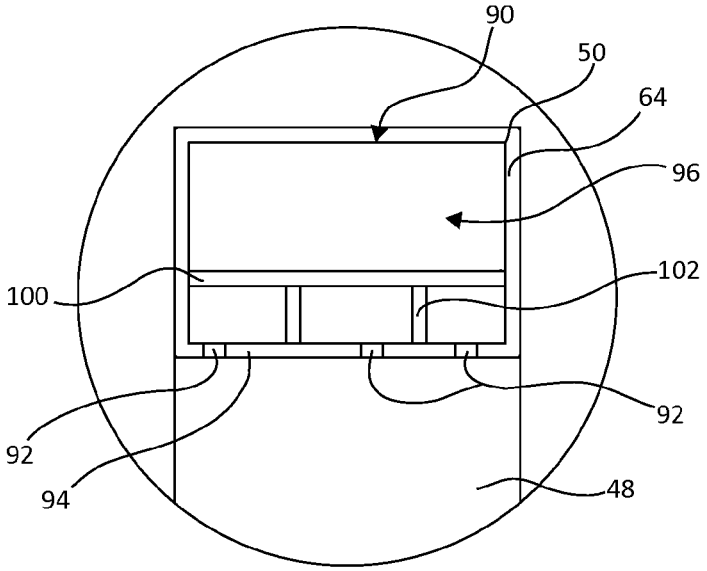
FIG. 8 is an end view illustration of an arm of the end frame assembly of FIG. 7, according to one embodiment of the present invention.
Figure 9:
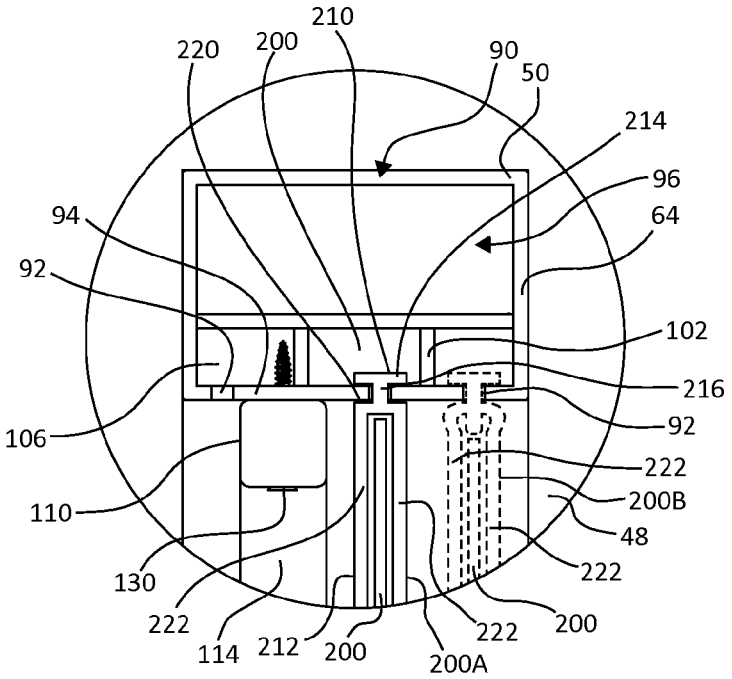
FIG. 9 is end view illustration of the arm of the end frame assembly of FIG. 8 additionally including sign holders attached thereto, according to one embodiment of the present invention.

Referring largely to the enlarged illustrations in FIGS. 8 and 9, arm 50 includes features for selectively receiving signs directly or signs via sign holders (e.g., see sign holders 200 described below). In one example, such features include elongated tracks or elongated slots 92 extending through a bottom panel 94 of arm 50, for example, along a substantial entirety of the length of arm 50. In one embodiment, arm 50 is hollow and defines a cavity 96 as well as a substantially horizontally extending interior wall 100 and substantially vertically extending interior walls 102 therein to provide additional structural integrity to arm 50. In accordance with an embodiment, cavity 96 of arm 50 is divided into top and bottom portions by substantially horizontally extending interior wall 100, which extends across a substantial entirety of a lateral width of cavity 96. In one example, each of the substantially vertically extending interior walls 102 extends between bottom panel 94 and substantially horizontally extending interior wall 100 collectively providing additional structural rigidity to arm 50. In one embodiment, one of substantially horizontally extending interior walls 100 is positioned between adjacent ones of elongated slots 92 to provide additional rigidity to bottom panel 94 and support thereto when signs are hung through elongated slots 92 and supported by bottom panel 94, as will be further described below.

Extension member or support frame 46 is substantially U-shaped or C-shaped and configured to provide structural support for arm 50 especially toward free end 64, which is spaced furthest from the vertical support of elongated post 48. As illustrated, support frame 46 includes a top segment 110, a bottom segment 112, and a side segment 114 extending from and between top and bottom segments 110 and 112. Top and bottom segments 110 and 112 are substantially equal in length to, are spaced from, and extend substantially parallel to each other, and, upon assembly with primary structure 44, extend parallel to arm 50. In order to fit within an original footprint of primary structure 44, both rails 110 and 112 are slightly shorter in length than arm 50 and narrower in width than arm 50 and elongated post 48.

In one example, top and side segments 110 and 112 include apertures 120 for receiving fasteners 130 when assembled with primary structure 44. Apertures 124 may or may not correspond with openings (not shown) formed in elongated post 48, or alternatively apertures 124 serve as guides for securing threaded or unthreaded fasteners 130 at predetermined locations along arm 50 or on interior-facing surface 70 of elongated post 48 during assembly. In an embodiment, apertures 124 are formed on top segment 110 (apertures not shown) and guide fasteners 130 to locations on top segment 110 for securing top segment 110 to arm 50. In one example, support frame 46 is laterally positioned closer to a rear of end frame assembly 12 than to a front of end frame assembly 12. Support frame 46 is attached to arm 50 so as not to impede access to elongated slots 92 in arm 50. In one embodiment bottom segment 112 includes a downwardly extending flange 132 near a free end 134 thereof opposite side segment 114. Downwardly extending flange 132 is configured to be coupled with a side of display structure 11, such as vertically extending support 18, to further secure support frame 46 and all of end frame assembly 12 to display structure 11.

In one embodiment, end frame assembly 12 includes coupling mechanisms 140 and 142 to each facilitate coupling end frame assembly 12 with display structure 11. Coupling mechanisms 140 and 142 are used for securing bottom and top portions, respectively, of elongated post 48 to vertically extending support 16 of display structure 11 (e.g., FIG. 1). Coupling mechanism 140 includes a gondola hook bracket 144 and a locking tab 146. Additionally referring to FIG. 7 and the enlarged view of FIG. 10, in one example, gondola hook bracket 144 is made up of a substantially planar plate 150 configured to lay flat against interior-facing surface 70 of elongated post 48, an offset portion 152, and three prongs 154 extending from offset portion 152 opposite substantially planar plate 150. Each prong 154 is configured to be inserted into a corresponding one of the slots in the array of slots 34 on vertically extending support 16 to selectively secure gondola hook bracket 144 to vertically extending support 16. Offset portion 152 laterally spaces three prongs 154 from interior-facing surface 70 of elongated post 48.

Figure 7:
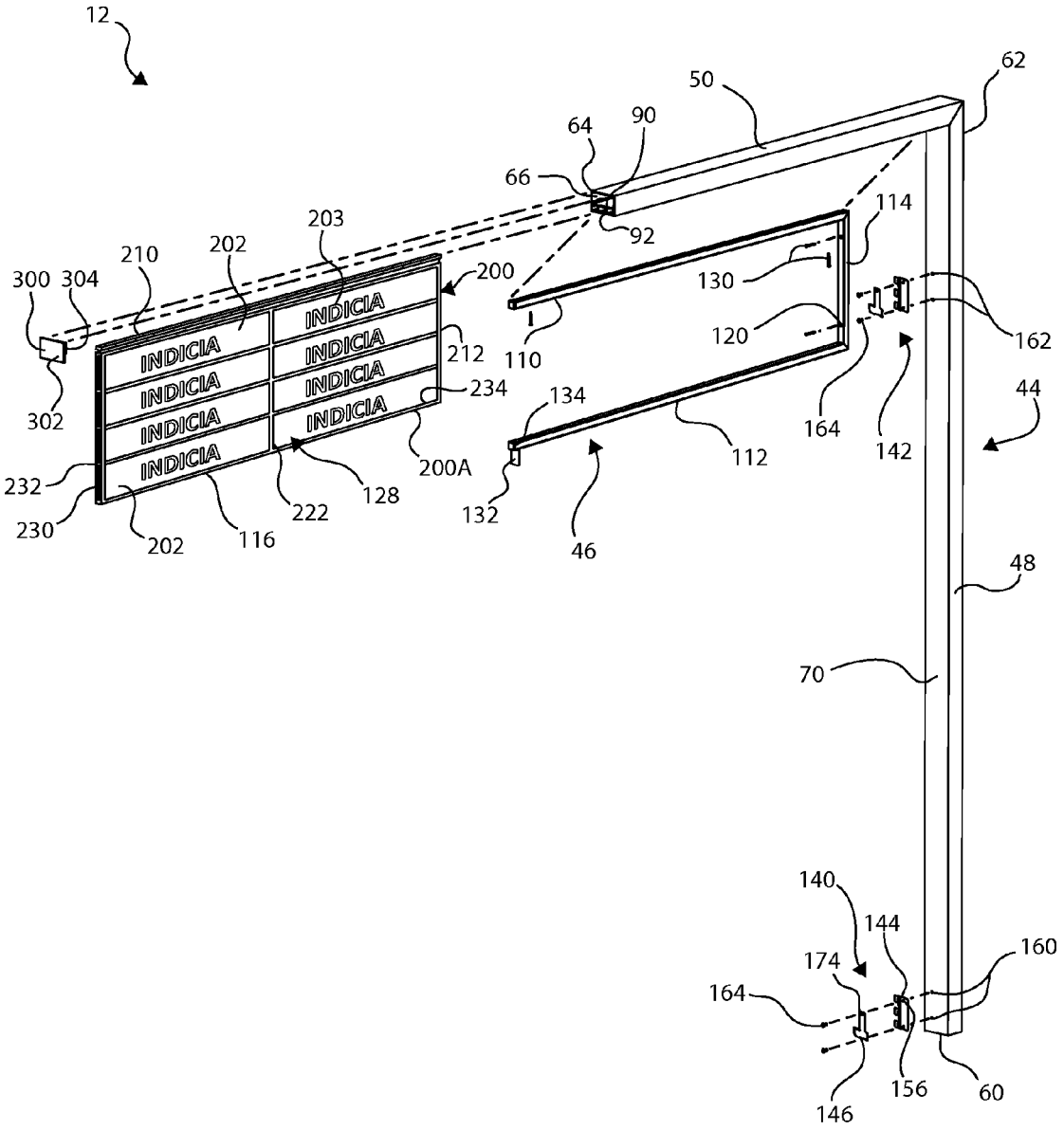
FIG. 7 is an exploded view illustration of the end frame assembly of FIG. 1, according to one embodiment of the present invention.

In one example, substantially planar plate 150 includes apertures 156 extending therethrough and configured to align with one of two pairs of openings 160 and 162 formed through interior-facing surface 70 of elongated post 48 to receive fasteners 164, such as rivets, screws, bolts and the like extending through substantially planar plate 150 and interior-facing surface 70 to secure coupling mechanisms 140 and 142 to elongated post 48, respectively, as illustrated with particular reference to FIGS. 7 and 10.

Locking tab 146 is substantially an inverted L-shape defining a drop section 170 and a lock section 172, which are each substantially linear, in the illustrated embodiment. Drop section 170 includes an opening 174 near a top thereof configured to align with a top aperture 156 in gondola hook bracket 144 and an opening 160 of elongated post 48. In this manner, a single fastener 164 couples locking tab 146 to gondola hook bracket 144 and each of locking tab 146 and gondola hook bracket 144 to elongated post 48. Lock section 172 extends from an end of drop section 170 opposite opening 174 and extends, for example, in a direction substantially perpendicular to the extension of drop section 170. Locking tab 146 is rotatable relative to fastener 164 so that a hook portion of locking tab 146 locks gondola hook bracket 144, and hence, elongated post 48 in position on vertically extending support 16 (or vertically extending support 18), when hook portion of tab 146 is inserted into corresponding slot 34 or 36 on vertically extending support 16 (or support 18, in other embodiments).

In other words, in one embodiment, locking tab 146 is configured to rotate about fastener 164 as generally indicated by arrow 176 in FIG. 10 (e.g., about an axis extending substantially perpendicularly to interior-facing surface 70 of elongated post 48) to selectively be received in one slot of the array of slots 34 in a manner preventing or at least decreasing inadvertent lifting of end frame assembly 12 relative to display structure 11. As such, locking tab 146 generally is rotated about fastener 164 out of one of the array of slots 34 before end frame assembly 12 can be lifted and pulled outwardly away from display structure 11 to remove end frame assembly 12 therefrom. In one embodiment, coupling mechanisms 140 and 142 are substantially identical or otherwise are formed and/or function in a substantially identical manner. While coupling mechanism 140 is described in detail above, it should be understood that, in one example, coupling mechanism 142 is substantially identical to coupling mechanism 140.

One or more sign holder 200 is supported by arm 50 of primary structure 44, and each sign holder 200 retains one or more sign 202 bearing indicia 203. Indicia 203 may include any one or more of graphics, text, artwork, etc. and may provide navigational indicators to consumers, indicate a season, sale or occasion at the retail store, advertise a feature or price of products 40 displayed on display structure 11, etc. Sign holders 200 may take on any one of a plurality of different configurations, but in one embodiment, each sign holder 200 includes a top, longitudinally extending, rail section 210 and a sign retaining section 212 depending downwardly therefrom as generally shown in FIGS. 7 and 9. Referring to FIG. 9, rail section 210 defines a cap 214 and a spacer fin 216. Spacer fin 216 extends upwardly from a top of sign retaining section 212, and in one example, has a length substantially equal to sign retaining section 212. Spacer fin 216 extends substantially vertically with a thinner cross-section as compared with sign retaining section 212. Cap 214 extends across a substantial entirety of a length of sign retaining section 212, and has a shorter but wider cross-section relative to spacer fin 216. Cap 214 extends directly over and adjacent spacer fin 216, and, in one instance, is substantially, laterally centered relative to spacer fin 216 such that cap 214 and spacer fin 216 collectively have a T-shaped cross section.

Sign retaining section 212 includes a top surface 220 and a pair of opposite retaining panels 222. Top surface 220 has a width greater than a width of spacer fin 216, and in one example, substantially identical to a width of cap 214. In one embodiment, top surface 220 directly abuts and is laterally centered relative to spacer fin 216 such that an elongated groove 224 is formed on each side of spacer fin 216 between cap 214 of rail section 210 and top surface 220 of sign retaining section 212.

Retaining panels 222 each extend downwardly from laterally opposite sides of top surface 220, and retaining panels 222 are configured to hold one or more sign 202 therebetween such as a substantially planar sign 202. In one embodiment, the one or more sign holder 200 includes sign holder 200A shown in FIGS. 1-7 and 9. Retaining panels 222 of sign holder 200A are rigidly maintained to extend in substantially parallel planes spaced from one another to form a slot 230 therebetween for receiving one or more sign 202. In one example, sign holder 200 includes one or more slot dividers 232 dividing slot 230 into a plurality of compartments each configured to slidably receive a different sign 202. Sign holder 200A additionally defines one or more aperture 234 through retaining panels 222 to allow viewing of signs 202 therethrough. In one embodiment, the one or more sign holder 200 includes sign holder 200B shown in broken lines in FIG. 9 as it is not shown in other views. Sign holder 200B includes flexible retaining panels 222 that extend only a short distance from rail section 210 and are biased toward each other. Accordingly, for sign holder 200B, the one or more signs 202 are held by sign holder 200B by compression between the two retaining panels 222. Sign holders 200 may additionally use adhesive, hook-and-loop fasteners, magnets, or other fasteners or features to facilitate selective maintenance of sign(s) 202.

Each sign holder 200 is coupled with arm 50 by sliding rail section 210 through elongated slots 92. More particularly, rail section 210 of each sign holder 200 enters a corresponding elongated slot 92 via opening 90 at free end 64 of arm 50 and is slid toward elongated post 48 until each sign holder 200 is in a desired position, for example, positioned such that a width of each sign holder 200 is substantially aligned with a width of arm 50. In one example, sign holder 200A nearly or actually contacts interior-facing surface 70 of elongated post 48 when finally positioned relative to arm 50. As sign holder 200 is being slid through elongated slots 92 and upon final positioning of sign holder 200, spacer fin 216 extends through the respective elongated slot 92 such that cap 214 is positioned in cavity 96. Interior edges of bottom panel 94 adjacent elongated slots 92 are positioned in elongated grooves 224 on each side of spacer fin 216 between cap 214 of rail section 210 and top surface 220 of sign retaining section 212. In this manner, sign holders 200 hang from bottom panel 94 of arm 50, and in one example, hang to touch or extend just above top surface 42 of display structure 11 to substantially cover the space between top surface 42 of display structure 11 and bottom panel 94 of arm 50.

In one example, sign holder 200A supports signs 202 including navigational indicia 203 listing products or product types on display structure 11 or in an aisle immediately adjacent display structure 11 and generally remain coupled with arm 50 for longer periods of time than sign holder 200B. Sign holder 200B can be slid in an elongated slot 92 adjacent elongated slot 92 maintaining sign holder 200A as illustrated, for example, in FIG. 9 such that sign 202 in sign holder 200B substantially covers sign holder 200A and any signs 202 therein. The dual reception of sign holders 200A and 200B by arm 50 is particularly advantageous when temporary marketing or similar indicia 203 is desired to be presented, as the temporary signage, for example, in sign holder 200B can be placed over sign holder 200A without removing sign holder 200A. As such, once the event, sale, etc. associated with signs 202 of sign holder 200B ends, sign holder 200B is removed and the navigational indicia 203 of signs 202 in sign holder 200A remains and is once again visible. The dual reception of sign holders 200 is further advantageous in keeping the space between top surface 42 of display structure 11 and bottom panel 94 of arm 50 filled at nearly all times, which may be more aesthetically desired, and in eliminating the need for one to search out the proper sign holder 200A and navigational signs 202 to replace them over display structure 11 when sign holder 200B is removed since the proper sign holder 200A is already there.

A plug or cover 300 is configured to cover opening 90 of arm 50 thereby substantially covering elongated slots 92 from end view. In one example, cover 300 includes a primary panel 302 and sidewalls 304 extending substantially perpendicularly to and inset from an outer perimeter of primary panel 302. Sidewalls 304 are configured to frictionally fit with a top wall and/or sidewalls of arm 50 and/or interior wall 100 of arm 50 to remain coupled to free end 64 of arm 50 covering opening 90. In one example, an exterior surface of primary panel 302 includes indicia, such as a number or other designation of an aisle (e.g., "A12") that display structure 11 is located near and/or partially defines.

End frame assembly 12, according to one embodiment, is substantially assembled before installing end frame assembly 12 on display structure 11. For example, referring to FIG. 7, in one embodiment, elongated post 48 and arm 50 are secured to one another, if they are not initially formed as a single piece, to form primary structure 44. Support frame 46 is coupled with primary structure 44. More particularly, top segment 110 is secured to bottom panel 94 of arm 50 and side segment 114 is secured to an upper portion of elongated post 48 adjacent interior-facing surface 70 via fasteners 130 and/or other means. Coupling mechanisms 140 and 142 are coupled to interior-facing surface 70 through pre-formed apertures 160 and 162 such that prongs 154 and lock section 172 of locking tab 146 face rearwardly.

With additional reference to FIG. 1, during installation of end frame assembly 12 on display structure 11, end frame assembly 12 is roughly positioned such that elongated post 48 is positioned just forwardly of substantially vertically extending support 16 and arm 50 is spaced forwardly from top surface 42 of display structure 11. Subsequently, end frame assembly 12 is lifted and prongs 154 of coupling mechanisms 140 and 142 are slid into desired slots in the array of slots 34 along forward surface 30 of substantially vertically extending support 16. Near simultaneously, bottom segment 112 of support frame 146 is positioned directly adjacent and to be supported by top surface 42 of display structure 11. Once all of end frame assembly 12 is properly positioned, locking tab 146 is rotated to position lock section 172 at least partially in one slot of the array of slots 34 to decrease the likelihood of inadvertent removal of end frame assembly 12 from display structure 11. In addition, in one example, bottom segment 112 of support frame 146 is secured to top surface 42 of display structure 11 and flange 132 to a side of substantially vertically extending support 18. In one embodiment, bottom segment 112 rests on support frame 46 and flange 132 interfaces with substantially vertically extending support 18 without permanently securing such components to one another.

Next, one or more sign holder 200 is slid into cavity 90 of arm 50 via its respective elongated slot 92. More particularly, each sign holder 200 is coupled with arm 50 by sliding rail section 210 thereof through one of elongated slots 92 via opening 90 in arm 50 at free end 64 of arm 50 until a width of each sign holder 200 is substantially aligned with a width of arm 50. As sign holder 200 is being slid through elongated slots 92 and upon final positioning, spacer fin 216 extends through the respective elongated slot 92, and cap 214 is positioned in cavity 96. Edges of bottom panel 94 of arm 50 that are adjacent elongated slots 92 are positioned in elongated grooves 224, which are defined between cap 214 and top surface 220. In this manner, sign holders 200 hang from bottom panel 94 of arm 50, and in one example, hang to touch or extend just above top surface 42 of display structure 11 to substantially cover the space between top surface 42 of display structure 11 and bottom panel 94 of arm 50. Once sign holder 200 is positioned, signs 202 are slid into or otherwise coupled with sign holder 200 and coupled to arm 50. Other variations regarding assembly and installation of end frame assembly 12 as will be apparent to those of skill in the art upon reading this application.

FIGS. 10-14 are various views of a display system 210 including a display structure 11, as described above, and an end frame assembly 212 coupled thereto. In comparison to display system 10 of FIGS. 1-5, end frame assembly 212 of display system 210 omits support frame 46. End frame assembly 212 includes a primary structure 244 that is L-shaped and has an elongated post 248 and an arm 250 substantially similar in configuration to primary structure 44 having elongated post 28 and arm 50, except post 248 of primary structure 244 is shorter than elongated post 48 of primary structure 44. Consequently, arm 250 rests directly on top of display structure 211, for example, over a top edge 42 thereof. In one embodiment, arm 250, like arm 50 includes an opening 90 providing access to open ends of elongated slots 92 formed in bottom panel 94. A sign holder (not shown), for example, sign holder 200A and 200B described above, are slid into elongated slots 92 via opening 90 and hang downwardly from arm 250.

End frame assembly 212 is coupled to display structure 11 using coupling mechanisms 140 and 142 similar to end frame assembly 12. However, arm 250 is positioned to lay directly over top surface 42 of display structure 11. In one example, arm 250 additionally includes a flange 252 extending downwardly from a free end 64 thereof and being secured directly to rail 18 of display structure 11 to provide additional rigidity to end frame assembly 212 and safety to passersby.

Including end frame assembly 12 or 212 on display structure 11 or 211 increases signage display area without significantly increasing the footprint of display structure 11 and 211. More particularly, end frame assemblies 12 and 212 provide surfaces for including indicia to alert customers to directory, product, department, or other information. Additionally, usage of a signage primary structure vertically adds to the display area of end frame assembly 12 allowing for seemingly endless possibilities for extending display space above displayed products. Moreover, end frame assemblies 12 and 212 improve aesthetics and interest to display structures 11 and 211 by providing visual depth to displays.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. An end frame assembly configured to be coupled to a product display structure, the end frame assembly comprising:

an elongated post defining and extending between a bottom end and a top end, wherein the elongated post defines an interior-facing surface configured to be placed adjacent a side edge of the product display structure;

an arm coupled to and extending away from the top end of the elongated post to define a free end opposite the elongated post, the arm defining an internal cavity and including a bottom panel defining two or more slots extending longitudinally through the bottom panel of the arm between the free end and the elongated post, wherein each of the two or more slots provides access to the internal cavity;

a sign holder defining a top edge including a rail section, wherein the rail section of the sign holder slidably couples with the arm via one of the two or more slots and is at least partially maintained within the internal cavity of the arm, and the sign holder extends through the one of the two or more slots and hangs downwardly from the bottom panel of the arm; and a coupling mechanism attached to the interior-facing surface of the elongated post, wherein the coupling mechanism includes a plurality of prongs extending in a direction substantially parallel to the interior-facing surface, and each of the plurality of prongs is configured to be received by one of corresponding apertures defined by the product display structure.

2. The end frame assembly of claim 1, further comprising a support frame including a top segment, a bottom segment opposite the top segment, and a side segment connecting the top segment to the bottom segment, wherein the top segment is coupled to the bottom panel of the arm.

3. The end frame assembly of claim 2, wherein each of the top segment and the bottom segment extend in a single direction from the side segment and are only connected to one another via the side segment.

4. The end frame assembly of claim 2, wherein the arm and the top segment collectively extend as a cantilever from the elongated post and the side segment of the support frame.

5. The end frame assembly of claim 2, in combination with the product display structure, wherein:

the product display structure defines a substantially vertically extending side edge and a top edge, the elongated post is coupled to the substantially vertically extending side edge of the product display structure, and the bottom segment of the support frame rests on the top edge of the product display structure providing additional support to the arm.

6. The end frame assembly of claim 2, wherein:

the sign holder includes a sign retainer assembly extending downwardly from the rail section, and the sign retainer assembly includes opposing retainer panels configured to selectively maintain one or more signs therebetween.

7. The end frame assembly of claim 1, wherein:

the sign holder includes a sign retaining section coupled to the rail section, the rail section includes a spacer fin extending upwardly from the sign retaining section and a cap extending across the spacer fin opposite the sign retaining section, the spacer fin and the cap collectively define the rail section to have a substantially T-shaped transverse cross section, and when the sign holder is coupled to the arm, the cap is maintained in the internal cavity of the arm and the spacer fin extends through the one of the two or more slots.

8. The end frame assembly of claim 1, wherein the elongated post and the arm collectively define a primary structure of the end frame assembly in an inverted L-shape.

9. The end frame assembly of claim 1, wherein:

the sign holder is a first sign holder, the rail section is a first rail section, the end frame assembly further comprises a second sign holder including a second rail section, the second rail section of the second sign holder slidably couples with the arm via a different one of the two or more slots to partially fit within the internal cavity, and the second sign holder hangs downwardly from the bottom panel of the arm extending substantially parallel to and at least partially covering the first sign holder.

10. The end frame assembly of claim 1, in combination with a product display structure and a sign, wherein the product display structure defines a substantially vertically extending side edge and a top edge, wherein the elongated post of the end frame assembly is coupled to the substantially vertically extending side edge of the product display structure, and the bottom segment of the support frame of the end frame assembly rests on the top edge of the product display structure to provide additional support to the arm, and the sign is maintained by the sign holder opposite the retail section of the sign holder such that the sign hangs downwardly from the sign holder directly above the top edge of the product display structure.

11. A combination comprising:

an end frame assembly comprising:

an elongated post defining and extending between a bottom end and a top end, an arm coupled to and extending away from the top end of the elongated post to define a free end opposite the elongated post, the arm defining an internal cavity and including a bottom panel defining two or more slots extending longitudinally through the bottom panel of the arm between the free end and the elongated post, wherein each of the two or more slots provides access to the internal cavity, a sign holder defining a top edge including a rail section, wherein the rail section of the sign holder slidably couples with the arm via one of the two or more slots and is at least partially maintained within the internal cavity of the arm, and the sign holder extends through the one of the two or more slots and hangs downwardly from the bottom panel of the arm, and a support frame including a top segment, a bottom segment opposite the top segment, and a side segment connecting the top segment to the bottom segment, wherein the top segment is coupled to the bottom panel of the arm; and a product display structure defining a substantially vertically extending side edge and a top edge, wherein the elongated post of the end frame assembly is coupled to the substantially vertically extending side edge of the product display structure, and the bottom segment of the support frame of the end frame assembly rests on the top edge of the product display structure to provide additional support to the arm.

12. The combination of claim 11, wherein:

the end frame assembly includes a coupling mechanism attached to the elongated post at a position spaced from each of the bottom end and the top end of the elongated post, and the coupling mechanism is coupled with the product display structure substantially without the use of tools.

13. The combination of claim 12, wherein:

the product display structure defines a substantially linear array of apertures extending adjacent the substantially vertically extending side edge of the product display structure, and the coupling mechanism includes two or more prongs each selectively maintained within a different aperture of the substantially linear array of apertures.

14. The combination of claim 13, wherein:

the coupling mechanism includes a rotatable locking tab configured to rotate about an axis extending substantially perpendicular to a surface of the elongated post facing the product display structure to selectively fit within one aperture of the substantially linear array of apertures to lock the end frame assembly in position relative to the product display structure, and the one aperture differs from any of the different apertures of the substantially linear array of apertures receiving one of the two or more prongs.

15. An end frame assembly configured to be coupled to a product display structure, the end frame assembly comprising:

an elongated post defining and extending between a bottom end and a top end;

an arm coupled to and extending away from the top end of the elongated post to define a free end opposite the elongated post, the arm defining an internal cavity and including a bottom panel defining two or more slots extending longitudinally through the bottom panel of the arm between the free end and the elongated post, wherein each of the two or more slots provides access to the internal cavity;

a sign holder defining a top edge including a rail section, wherein the rail section of the sign holder slidably couples with the arm via one of the two or more slots and is at least partially maintained within the internal cavity of the arm, and the sign holder extends through the one of the two or more slots and hangs downwardly from the bottom panel of the arm; and a support frame including a top segment, a bottom segment opposite the top segment, and a side segment connecting the top segment to the bottom segment, wherein the top segment is coupled to the bottom panel of the arm;

wherein the side segment is coupled to the elongated post.

16. A display system including:

a display structure including:

two substantially vertically extending supports spaced from one another, product supports extending between the two substantially vertically extending supports and being configured to support products being offered for sale, and a top edge extending from one of the two substantially vertically extending supports to the other of the two substantially vertically extending supports, wherein the two substantially vertically extending supports each define a substantially vertically extending array of apertures; and an auxiliary assembly including:

an elongated coupling member defining a top portion and being positioned directly adjacent one of the two substantially vertically extending supports, wherein the elongated coupling member defines an interior surface facing toward the other one of the two substantially vertically extending supports, a sign support member cantilevering from the top portion of the elongated coupling member toward the other one of the two substantially vertically extending supports, and a hook bracket coupled to the interior surface of the elongated coupling member and including prongs spaced from the interior surface of the elongated coupling member and extending substantially parallel to the interior surface of the elongated coupling member;

wherein:

the elongated coupling member is coupled to the one of the two substantially vertically extending supports by placing each of the prongs of the hook bracket in a different aperture of the substantially vertically extending array of apertures defined by the one of the two substantially vertically extending supports to couple the auxiliary assembly to the display structure such that the sign support member extends over the top edge of the display structure, the auxiliary assembly further comprises a substantially C-shaped support frame including a first length, a second length extending from an end of the first length in a first direction substantially perpendicular to the first length, and a third length extending from an end of the second length opposite the first length in a second direction substantially parallel to the first length, the first length is coupled to the sign support member, the second length is coupled to the elongated coupling member, and the third length is coupled to the top edge of the display structure.

17. The display system of claim 16, wherein the elongated coupling member is sized to substantially cover an outside facing surface of the one of the two substantially vertically extending supports.

18. The display system of claim 16, wherein:

the sign support member is spaced above the top edge of the display structure, the auxiliary assembly further comprises a sign holder selectively coupled with the sign support member and hanging downwardly therefrom toward the top edge of the display structure, and the sign support member extends from the elongated coupling member as a cantilever.

19. The display system of claim 16, wherein the elongated coupling member and the sign support member collectively define a primary structure having an inverted L-shape.

20. A method of installing an end frame assembly on a display structure, the method comprising:

providing a primary structure including an elongated post and an arm extending away from a top end of the elongated post in a direction substantially perpendicular to an extension of the elongated post;

positioning the primary structure relative to the display structure, wherein the display structure includes two opposing substantially vertical supports and product supports positioned between the two opposing substantially vertical supports, and positioning the primary structure includes placing the elongated post adjacent one of the two opposing substantially vertical supports opposite the other one of the two opposing substantially vertical supports and placing the arm to extend over a topmost edge of the display structure;

selectively coupling the elongated post to the one of the two opposing substantially vertical supports;

hanging one or more signs from the arm of the primary structure;

coupling a support frame to the topmost edge of the display structure, wherein:

the support frame is substantially C-shaped defining a first segment, a second segment extending downwardly from the first segment, and a third segment extending from the second segment opposite the first segment and extending substantially parallel to the first segment, and coupling the support frame to the topmost edge of the display structure includes securing the third segment of the support frame to the topmost edge of the display structure; and coupling the in the first segment of the support frame to the arm.

21. The method of claim 20, wherein positioning the primary structure relative to the display structure includes positioning the arm to be directly adjacent to the topmost edge of the display structure and to extend substantially coextensively along the topmost edge of the display structure.

22. The method of claim 20, further comprising:

coupling the second segment of the support frame to the elongated post.

* * * * *